US006352289B1

(12) United States Patent
Fan

(10) Patent No.: US 6,352,289 B1
(45) Date of Patent: Mar. 5, 2002

(54) LOCK APPARATUS FOR A DOOR

(76) Inventor: Fang-Yi Fan, No. 186, Min-Kuo Rd., Tung Dist., Chiayi City (TW)

( * ) Notice: Subject to any disclaimer, the term of this patent is extended or adjusted under 35 U.S.C. 154(b) by 0 days.

(21) Appl. No.: 09/503,268

(22) Filed: Feb. 14, 2000

(51) Int. Cl.[7] ..... E05G 1/08
(52) U.S. Cl. ..... 292/226; 292/DIG. 24
(58) Field of Search ..... 292/226, 336.3, 292/DIG. 24

(56) References Cited

U.S. PATENT DOCUMENTS 2,776,157 A * 1/1957 Ellis
2,801,869 A * 9/1957 George
2,851,871 A * 5/1958 Newell
2,942,906 A * 6/1960 Gilpatrick

* cited by examiner

*Primary Examiner*—Anthony Knight
*Assistant Examiner*—Mark Williams
(74) *Attorney, Agent, or Firm*—Ladas & Parry

(57) ABSTRACT

In a lock apparatus, a latch member is rotatable with an operating lever about the axis of a spindle, and has a first end portion mounted pivotally on the operating lever about a pivot axis transverse to the spindle axis. A switch member is operable to move between a locking position, in which the switch member engages a notch in the operating lever to prevent operation of the operating lever, and an unlocking position, in which the switch member is disengaged from the operating lever to permit operation of the operating lever. The latch member is depressible to cause pivoting movement thereof about the pivot axis and to enable an opposite second end portion thereof to push the switch member and to move the switch member from the locking position to the unlocking position when the switch member is disposed in the locking position prior to depression of the latch member.

5 Claims, 6 Drawing Sheets

LOCK APPARATUS FOR A DOOR

BACKGROUND OF THE INVENTION

1. Field of the Invention

The present invention relates to a lock apparatus for a door, more particularly to a lock apparatus provided with a switch member that is operable from an inner side of a door and that prevents accidental locking of the door.

2. Description of the Related Art

A lock apparatus provided with a switch member that is operable only from one side of a door is known in the art. This kind of lock apparatus is typically installed on a door to a bathroom or a child's room, and is operable from an inner side of the door to permit locking of the door only by a person inside the room. Once the switch member is accidentally moved to a locking position and the door is then closed while nobody is inside the room, the door could be undesirably locked. This problem is frequently encountered in the aforesaid conventional lock apparatus, and causes considerable inconvenience to the user.

SUMMARY OF THE INVENTION

Therefore, the main object of the present invention is to provide a lock apparatus that can prevent accidental locking of a door to which the lock apparatus is applied.

Accordingly, the lock apparatus of the present invention includes a lock housing, a spindle, first and second operating levers, a latch member, a switch member and a biasing spring. The lock housing has a mounting wall formed with a spindle hole. The spindle extends through the spindle hole in the lock housing, and has opposite first and second ends. The first operating lever has a coupling portion coupled co-rotatably to the first end of the spindle, and a lever portion extending from the coupling portion. The lever portion is operable to cause axial rotation of the spindle. The second operating lever has a latch-mounting portion which is coupled co-rotatably to the second end of the spindle and which is mounted rotatably on the lock housing about an axis of the spindle. The second operating lever further has a lever portion extending from the latch-mounting portion, and a radially extending engaging flange formed on the latch-mounting portion. The engaging flange has a peripheral edge formed with a notch. The lever portion of the second operating lever is operable to cause axial rotation of the spindle together with the latch-mounting portion. The latch member is mounted on the latch-mounting portion, and is rotatable together with the latch-mounting portion about the axis of the spindle. The latch member has a first end portion mounted pivotally on the latch-mounting portion of the second operating lever about a pivot axis transverse to the axis of the spindle, and a second end portion opposite to the first end portion. The second end portion of the latch member is pivotable about the pivot axis toward and away from the latch-mounting portion. The switch member is mounted movably on the mounting wall of the lock housing, and is disposed adjacent to the engaging flange. The switch member is formed with an engaging protrusion, and is movable relative to the lock housing between a locking position, in which the engaging protrusion moves into the notch in the engaging flange and engages the engaging flange so as to prevent axial rotation of the latch-mounting portion and prevent rotation of the latch member with the latch-mounting portion relative to the lock housing, and an unlocking position, in which the engaging protrusion is disposed externally of the notch and disengages the engaging flange to permit axial rotation of the latch-mounting portion, thereby permitting rotation of the latch member with the latch-mounting portion relative to the lock housing. The biasing spring biases the second end portion of the latch member away from the latch-mounting portion. The latch member is depressible to move the second end portion of the latch member pivotally toward the latch-mounting portion about the pivot axis against biasing action of the biasing spring so as to enable the second end portion to push the switch member and move the switch member from the locking position to the unlocking position when the switch member is disposed in the locking position prior to depression of the latch member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
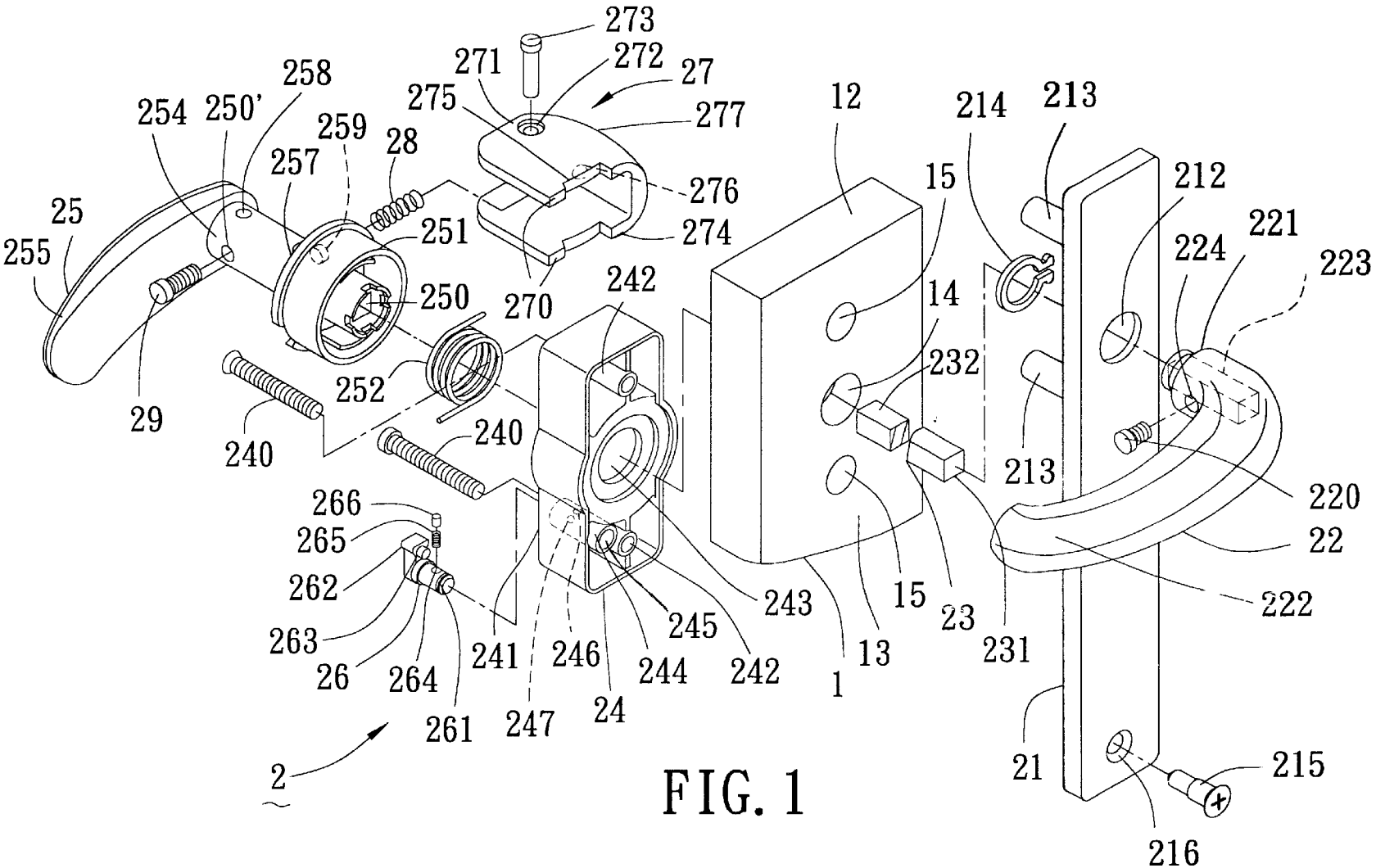
FIG. 1 is an exploded perspective view of a preferred embodiment of the lock apparatus of the present invention when applied to a door panel.
Figure 2:
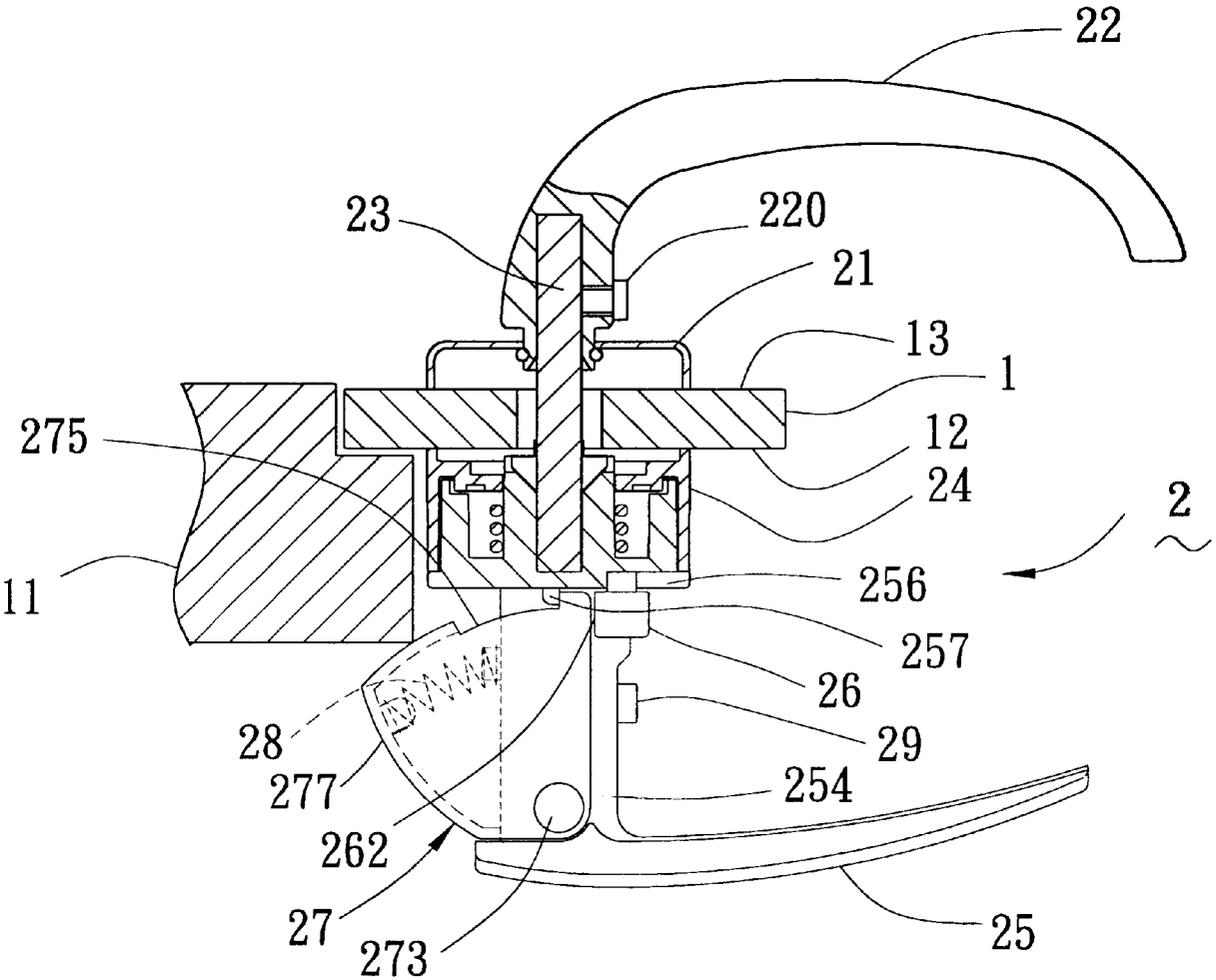
FIG. 2 is a cross-sectional top view of the preferred embodiment in a locking state, where the door panel is locked to an adjacent doorframe.
Figure 3:
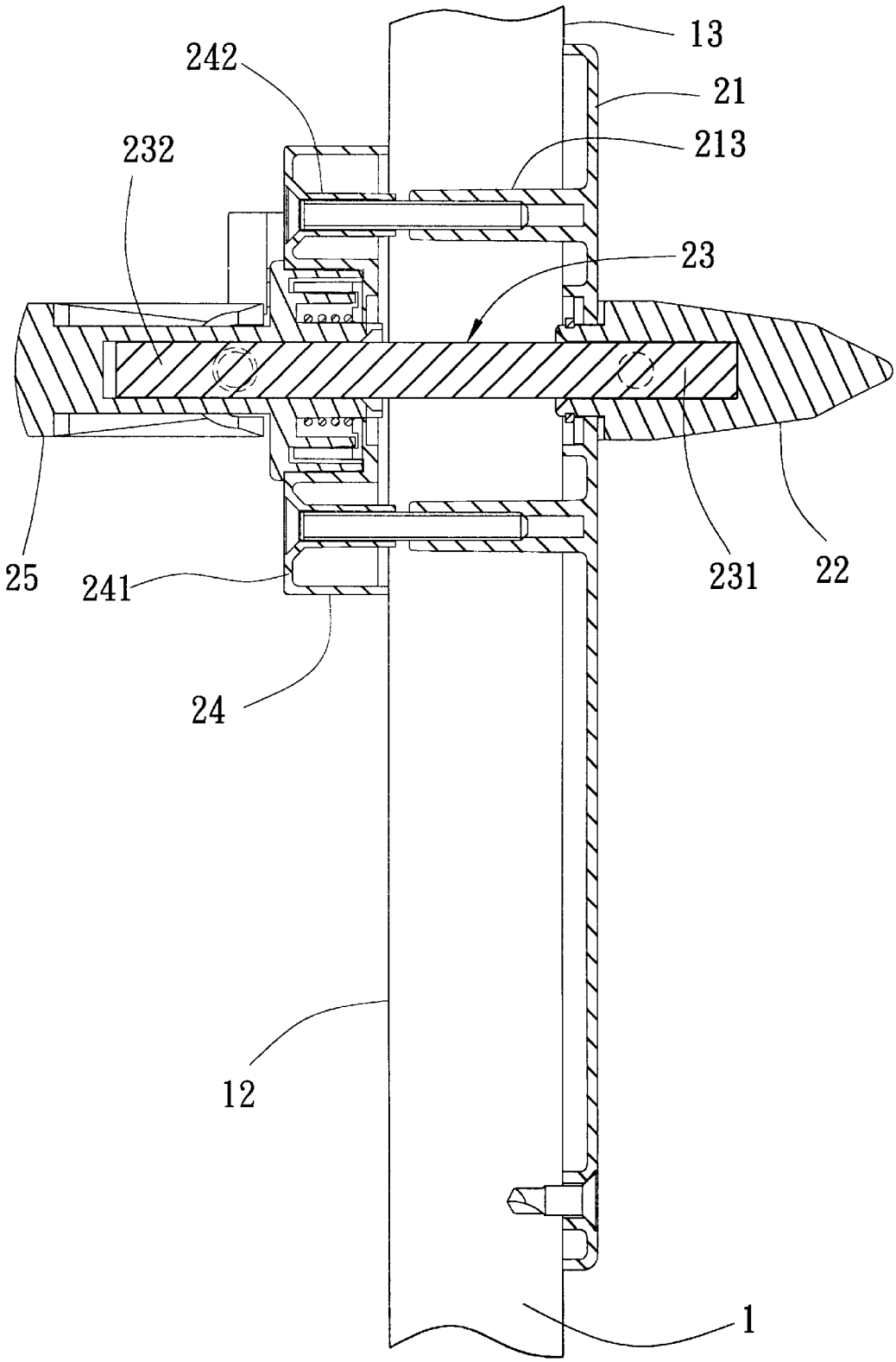
FIG. 3 is a cross-sectional side view of the preferred embodiment.

Referring to FIGS. 1 and 2, the preferred embodiment of the lock apparatus 2 of the present invention is adapted to be mounted on a door panel 1 at an entrance to a room, such as a bathroom. The door panel 1 has an inner surface 12 facing an interior of the room, and an opposite outer surface 13, and is movable pivotally toward and away from an adjacent doorframe 11. The lock apparatus 2 is shown to include an elongated escutcheon 21 adapted to be mounted on the outer surface 13 of the door panel 1, a first operating lever 22 disposed on an outer side of the door panel 1, a second operating lever 25 disposed on an inner side of the door panel 1, a spindle 23 extending through the door panel 1, a lock housing 24 adapted to be mounted on the inner surface 12 of the door panel 1, a latch member 27 mounted on the second operating lever 25, and a switch member 26 disposed on the inner side of the door panel 1 and mounted on the lock housing 24.

The door panel 1 is formed with upper and lower fastener holes 15 for mounting of the escutcheon 21 and the lock housing 24, and a spindle hole 14 between the fastener holes 15 for extension of the spindle 23 therethrough.

The escutcheon 21 has upper and lower fastener posts 213 that are threaded internally and that extend respectively into the fastener holes 15 in the door panel 1. The escutcheon 21 is formed with a spindle hole 212 adapted to be aligned with the spindle hole 14 in the door panel 1, and a fastener hole 216 at a lower end thereof to permit extension of a self-tapping screw 215 therethrough for fastening the escutcheon 21 to the door panel 1.

The spindle 23 has a rectangular cross-section, and extends rotatably through the spindle holes 14, 212 in the door panel 1 and the escutcheon 21. The spindle 23 has opposite first and second ends 231, 232 projecting respectively from the outer and inner surfaces 13, 12 of the door panel 1.

The first operating lever 22 is mounted rotatably on the escutcheon 21 by means of a C-shaped retaining ring 214. The first operating lever 22 has a coupling portion 221 formed with a blind spindle hole 223 with a cross-section conforming with that of the spindle 23 for receiving and for coupling co-rotatably with the first end 231 of the spindle 23. The first operating lever 22 further has a lever portion 222 that extends transversely from the coupling portion 221 and that is operable to cause axial rotation of the spindle 23. The coupling portion 221 is further formed with a threaded fastening hole 224 that extends in a radial direction relative to the spindle hole 223. A fastening bolt 220 is threaded into the fastening hole 224, and abuts tightly against the spindle 23 for retaining the same on the first operating lever 22.

The lock housing 24 is formed with upper and lower fastener posts 242 to be aligned with the fastener holes 15 in the door panel 1. A pair of screw bolts 240 extend through the fastener posts 242 of the lock housing 24, and into the fastener holes 15 in the door panel 1 and the fastener posts 213 of the escutcheon 21 for fastening the lock housing 24 to the door panel 1 and the escutcheon 21. The lock housing 24 has a mounting wall 241 parallel to the door panel 1 and formed with a spindle hole 243 to permit the spindle 23 to extend rotatably therethrough. The lock housing 24 has a tubular sleeve 244 that defines a switch-mounting hole 245 with an axis parallel to the spindle 23. The tubular sleeve 244 is formed with radial first and second positioning holes 246, 247 that are communicated with the switch-mounting hole 245 and that are angularly displaced from each other.

The second operating lever 25 includes a generally tubular latch-mounting portion 254 and a lever portion 255 extending transversely from one end of the latch-mounting portion 254. The latch-mounting portion 254 has an enlarged mounting end portion 251 mounted rotatably on the lock housing 24 about an axis of the spindle 23, and is formed with an axial spindle hole 250 which is aligned with the spindle hole 243 in the lock housing 24 and which has a cross-section conforming with that of the spindle 23 for receiving and for coupling co-rotatably with the second end 232 of the spindle 23. The latch-mounting portion 254 is further formed with a radially extending annular engaging flange 253 adjacent to the mounting end portion 251. The engaging flange 253 has a peripheral edge formed with a notch 256. A coiled torsion spring 252 is disposed in the lock housing 24 around the spindle 23, and has one end abutting against the lock housing 24, and an opposite end abutting against the second operating lever 25 for providing a restoring energy to the second operating lever 25 after the second operating lever 25 is operated to rotate relative to the lock housing 24 about the axis of the spindle 23. Similarly, the latch-mounting portion 254 is formed with a threaded fastening hole 250' that extends in a radial direction relative to the spindle hole 250. A fastening bolt 29 is threaded into the fastening hole 250', and abuts tightly against the spindle 23 for retaining the same on the second operating lever 25. The latch-mounting portion 254 is further formed with a radial pivot hole 258 adjacent to the lever portion 255, a limiting protrusion 257 adjacent to the engaging flange 253, and a positioning stud 259 at a lateral portion thereof.

The latch member 27 has a generally U-shaped cross-section with parallel first and second walls 270 that have the latch-mounting portion 254 disposed therebetween, and a connecting wall 277 interconnecting the first and second walls 270. The connecting wall 277 is formed with a curved cam surface adapted for contacting the doorframe 11. The latch member 27 has a first end portion 271 formed with a pivot hole 272 which is aligned with the pivot hole 258 in the latch-mounting portion 254. A pivot shaft 273 extends through the pivot holes 272, 258 for mounting the latch member 27 pivotally on the latch-mounting portion 254 about an axis of the pivot shaft 273 which is transverse to the axis of the spindle 23. The latch member 27 further has a second end portion 274 which is opposite to the first end portion 271 in a first direction and which has a distal edge formed with a limiting groove 275 that extends in a second direction transverse to the first direction. The limiting protrusion 257 on the latch-mounting portion 254 of the second operating lever 25 is disposed in the limiting groove 275 to limit pivoting movement of the second end portion 274 of the latch member 27 about the axis of the pivot shaft 273 toward and away from the latch-mounting portion 254. The second end portion 274 is further formed with a positioning stud 276 on an inner surface of the connecting wall 277 and opposite to the positioning stud 259 on the latch-mounting portion 254. A compression spring 28 has opposite ends disposed around the positioning studs 259, 276, and extends between the latch-mounting portion 254 and the connecting wall 277 of the latch member 27 for biasing the second end portion 274 of the latch member 27 away from the latch-mounting portion 254. As the pivot shaft 273 is transverse to the axis of the spindle 23, the latch member 27 is rotatable together with the latch-mounting portion 254 about the axis of the spindle 23 when either one of the first and second operating levers 22, 25 is operated to cause axial rotation of the spindle 23. Prior to operation of the first and second operating levers 22, 25, the latch member 27 is disposed in a position adapted to engage the doorframe 11 for retaining the door panel 1 on the doorframe 11. When the lever portion 222, 255 of either one of the first and second operating levers 22, 25 is operated by the user, the latch member 27 turns with the latch-mounting portion 254 of the second operating lever 25 to a position adapted to disengage from the doorframe 11 for releasing the door panel 1 from the doorframe 11. The first and second operating levers 22, 25 are biased by the torsion spring 252 to the non-operated state after the lever portion 222, 255 is released by the user.

The switch member 26 is mounted on the mounting wall 241 of the lock housing 24, and is disposed adjacent to the engaging flange 253 of the second operating lever 25. The switch member 26 has a cylindrical portion 261 extending rotatably into the switch-mounting hole 245 for mounting pivotally on the lock housing 24, and a head portion 262 which extends transversely from the cylindrical portion 261 and which is disposed adjacent to the second end portion 274 of the latch member 27. The head portion 262 is formed with an engaging protrusion 263 for engaging the notch 256 in the engaging flange 253. The cylindrical portion 261 is formed with a radial pinhole 264 that is provided with a biasing spring 265 and a positioning pin 266.

Figure 4:
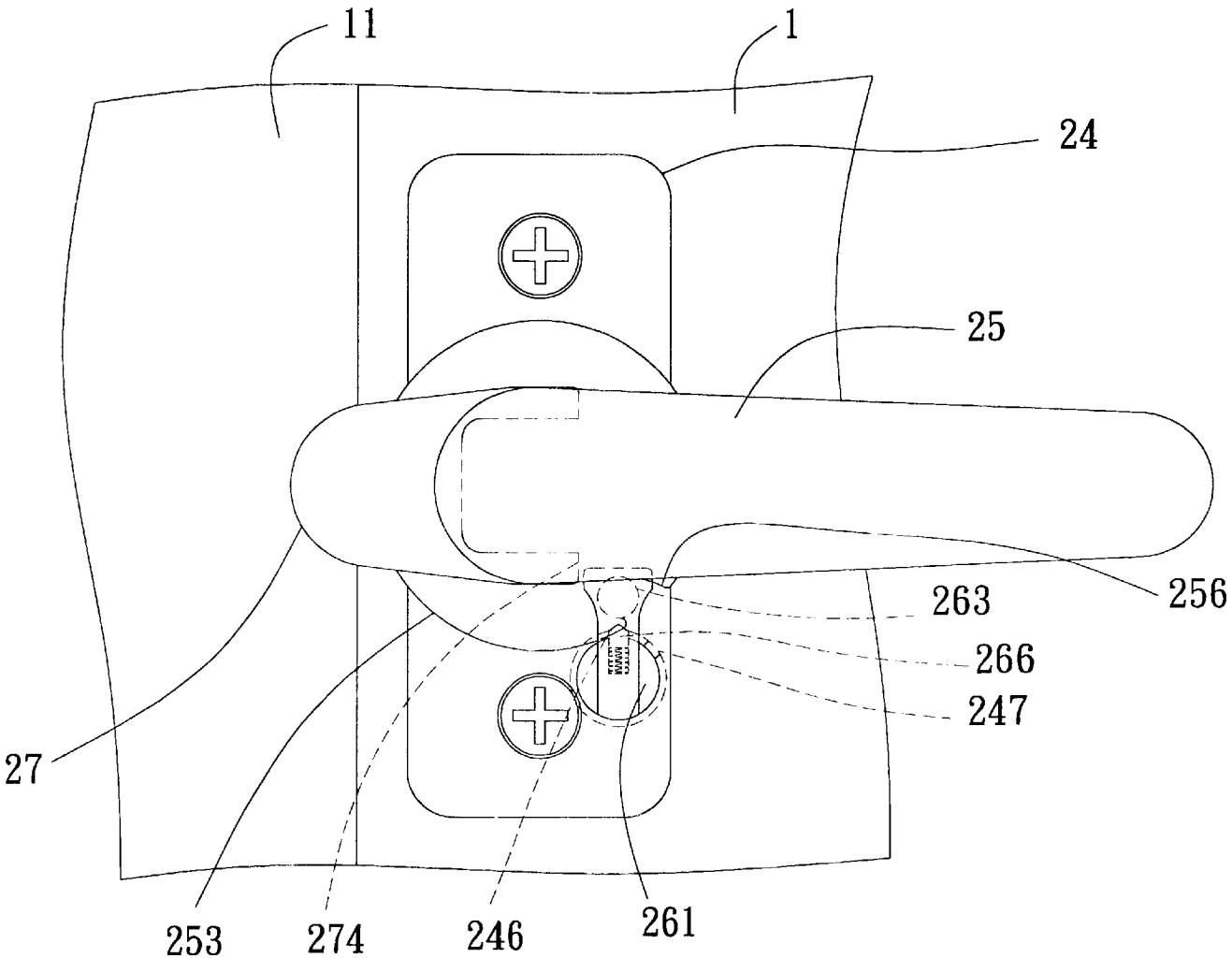
FIG. 4 is a schematic view of the preferred embodiment when in the locking state, viewed from an inner side of the door panel.
Figure 5:
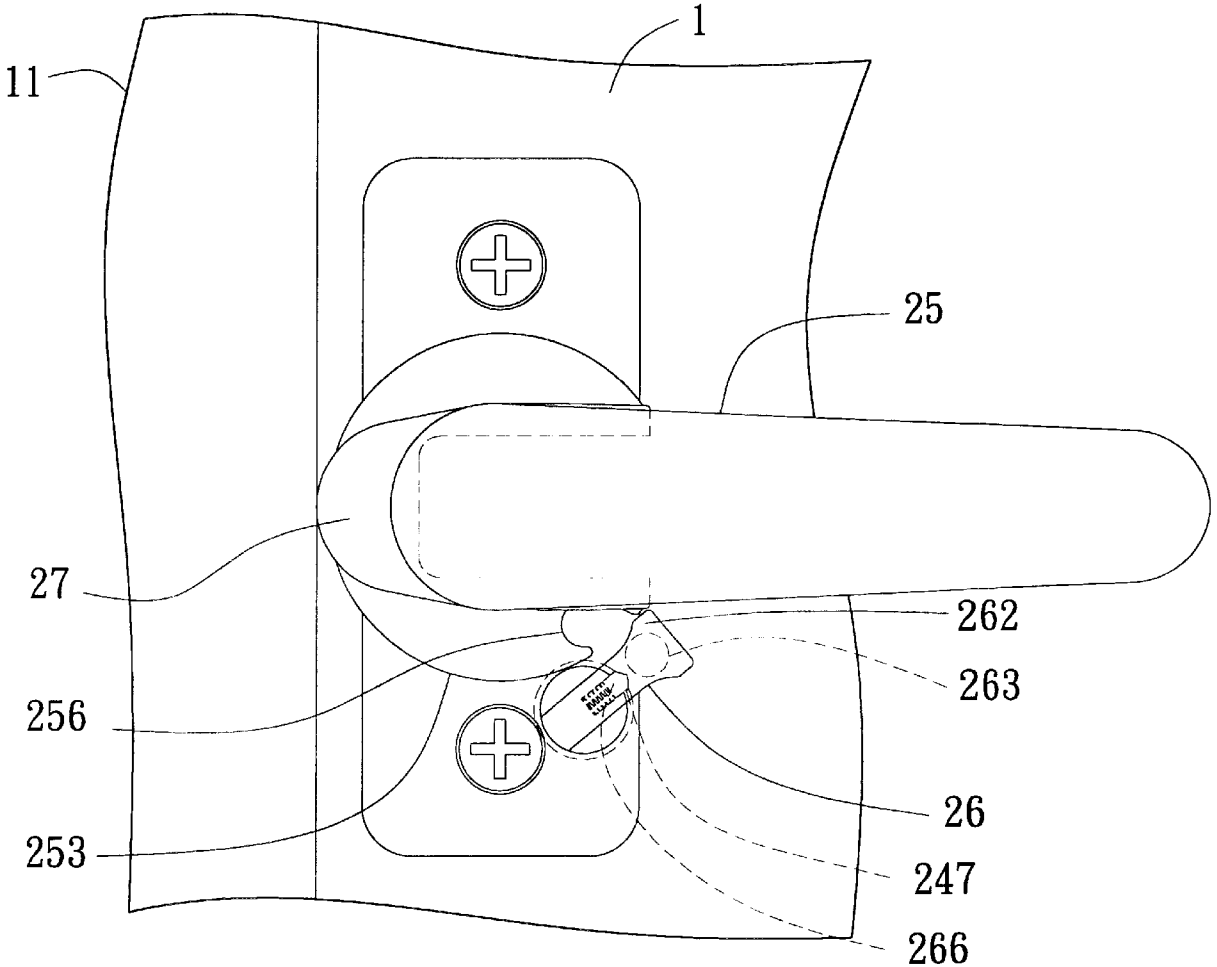
FIG. 5 is a schematic view of the preferred embodiment in an unlocking state.

The head portion 262 of the switch member 26 is operable to move pivotally about an axis of the cylindrical portion 261 to a locking position, as shown in FIG. 4, in which the engaging protrusion 263 moves into the notch 256 and engages the engaging flange 253 so as to prevent axial rotation of the latch-mounting portion 254 and prevent rotation of the latch member 27 with the latch-mounting portion 254 relative to the lock housing 24. At this time, the latch member 27 is locked at the door-frame-engaging position for locking the door panel 1 to the doorframe 11. The head portion 262 of the switch member 26 is further operable to move pivotally about the axis of the cylindrical portion 261 to an unlocking position, as shown in FIG. 5, in which the engaging protrusion 263 is disposed externally of the notch 256 and disengages the engaging flange 253 to permit axial rotation of the latch-mounting portion 254, thereby permitting operation of the first and second operating levers 22, 25 and rotation the latch member 27 with the latch-mounting portion 254 relative to the lock housing 24. When the switch member 26 is moved to the locking position, the positioning pin 266 is biased by the biasing spring 265 to extend into the first positioning hole 246 for retaining removably the switch member 26 in the locking position. When the switch member 26 is moved to the unlocking position, the positioning pin 266 is biased by the biasing spring 265 to extend into the second positioning hole 247 for retaining removably the switch member 26 in the unlocking position.

In use, the switch member 26 is operable from the inner side of the door panel 1 to move to the locking position after the door panel 1 is retained on the doorframe 11 by virtue of the engagement between the latch member 27 and the doorframe 11, thereby locking the door panel 1 to the doorframe 11. To open the door, the switch member 26 is operated to move to the unlocking position, as shown in FIG. 5, so as to permit operation of the first and second operating levers 22, 25 for disengaging the latch member 27 from the doorframe 1.

Figure 6:
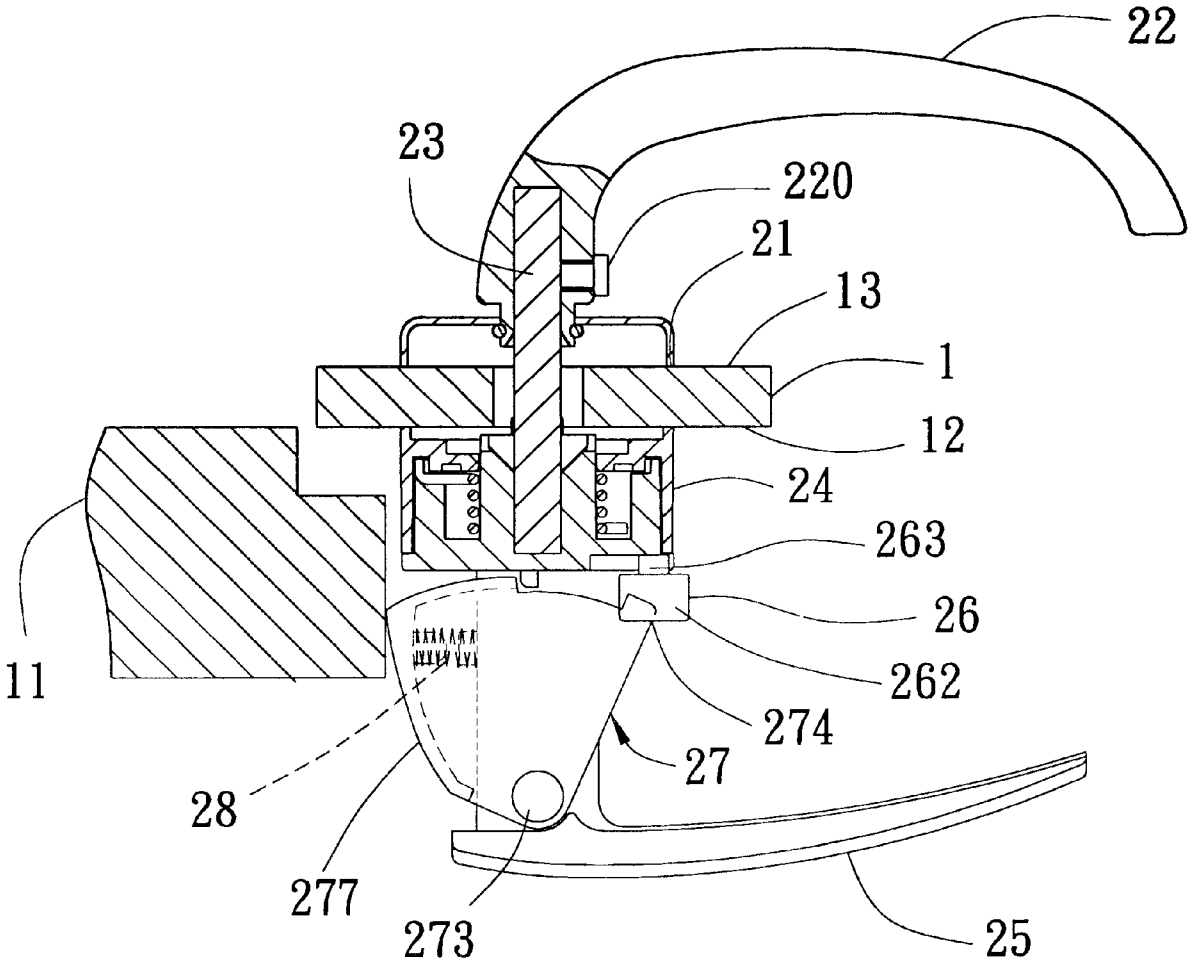
FIG. 6 is a cross-sectional top view of the preferred embodiment when the door panel is moved toward the doorframe.

Referring to FIGS. 4 to 6, in case the switch member 26 is accidentally operated and is moved to the locking position before the door panel 1 is moved toward the doorframe 11, subsequent movement of the door panel 1 toward the doorframe 11 will cause the curved cam surface of the connecting wall 277 of the latch member 27 to slide past the doorframe 11 to result in depression of the latch member 27, as shown in FIG. 6. At this time, the second end portion 274 of the latch member 27 is moved pivotally toward the latch-mounting portion 254 about the axis of the pivot shaft 273 and against the biasing action of the compression spring 28, and pushes the head portion 262 of the switch member 26 for moving the switch member 26 to the unlocking position, as shown in FIG. 5. Operation of the first and second operating levers 22, 25 is thus permitted at this time.

Therefore, in the lock apparatus of the present invention, once the switch member 26 is accidentally moved to the locking position before the door panel 1 is moved to the doorframe 11 and with nobody inside the room, subsequent movement of the door panel 1 toward the doorframe 11 will cause the latch member 27 to move the switch member 26 to the unlocking position. The lock apparatus of the present invention thus prevents accidental locking of the door panel 1 to the doorframe 11, and solves the problem that is frequently encountered in the aforementioned conventional lock apparatus.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A lock apparatus, comprising:

a lock housing having a mounting wall formed with a spindle hole;

a spindle extending through said spindle hole in said lock housing, said spindle having opposite first and second ends;

a first operating lever having a coupling portion coupled co-rotatably to said first end of said spindle, and a lever portion extending from said coupling portion, said lever portion being operable to cause axial rotation of said spindle;

a second operating lever having a latch-mounting portion which is coupled co-rotatably to said second end of said spindle and which is mounted rotatably on said lock housing about an axis of said spindle, a lever portion extending from said latch-mounting portion, and a radially extending engaging flange formed on said latch-mounting portion, said engaging flange having a peripheral edge formed with a notch, said lever portion of said second operating lever being operable to cause axial rotation of said spindle together with said latch-mounting portion;

a latch member mounted on said latch-mounting portion and rotatable together with said latch-mounting portion about the axis of said spindle, said latch member having a first end portion mounted pivotally on said latch-mounting portion of said second operating lever about a pivot axis transverse to the axis of said spindle, and a second end portion opposite to said first end portion, said second end portion of said latch member being pivotable about said pivot axis toward and away from said latch-mounting portion;

a switch member mounted movably on said mounting wall of said lock housing and disposed adjacent to said engaging flange, said switch member being formed with an engaging protrusion and being movable relative to said lock housing between a locking position, in which said engaging protrusion moves into said notch in said engaging flange and engages said engaging flange so as to prevent axial rotation of said latch-mounting portion and prevent rotation of said latch member with said latch-mounting portion relative to said lock housing, and an unlocking position, in which said engaging protrusion is disposed externally of said notch and disengages said engaging flange to permit axial rotation of said latch-mounting portion, thereby permitting rotation of said latch member with said latch-mounting portion relative to said lock housing; and a biasing spring for biasing said second end portion of said latch member away from said latch-mounting portion;

said latch member being depressible to move said second end portion of said latch member pivotally toward said latch-mounting portion about said pivot axis against biasing action of said biasing spring so as to enable said second end portion to push said switch member and move said switch member from the locking position to the unlocking position when said switch member is disposed in the locking position prior to depression of said latch member.

2. The lock apparatus according to claim 1, wherein said second end portion of said latch member is formed with a limiting groove, said latch-mounting portion of said second operating lever being formed with a limiting protrusion disposed in said limiting groove for limiting movement of said second end portion of said latch member toward and away from said latch-mounting portion.

3. The lock apparatus according to claim 1, wherein said lock housing has a tubular member confining a switch-mounting hole with an axis parallel to said spindle, said switch member having a cylindrical portion mounted pivotally in said switch-mounting hole and a head portion extending transversely from said cylindrical portion and formed with said engaging protrusion, said head portion being movable pivotally about the axis of said switch-mounting hole between the locking and unlocking positions, said second end portion of said latch member pushing said head portion of said switch member to move said switch member from the locking position to the unlocking position.

4. The lock apparatus according to claim 3, wherein said tubular member is formed with a radial first positioning hole and a radial second positioning hole that is angularly displaced from said first positioning hole, said switch member being provided with spring-loaded pin means that is extendible radially into a selected one of said first and second positioning holes for retaining removably said switch member at a respective one of the locking and unlocking positions.

5. The lock apparatus according to claim 1, wherein said latch member has a generally U-shaped cross-section, and includes parallel first and second walls which have said latch-mounting portion disposed therebetween, and a connecting wall interconnecting said first and second walls, said connecting wall being formed with a cam surface.

* * * * *